US008390981B1

(12) United States Patent
Treadaway et al.

(10) Patent No.: US 8,390,981 B1
(45) Date of Patent: Mar. 5, 2013

(54) FLARE IGNITION APPARATUS

(75) Inventors: Bruce Treadaway, Monahans, TX (US); William C. Treadaway, Monahans, TX (US)

(73) Assignees: Bruce Treadaway, Monahans, TX (US); William C. Treadaway, Monahans, TX (US)

( * ) Notice: Subject to any disclaimer, the term of this patent is extended or adjusted under 35 U.S.C. 154(b) by 668 days.

(21) Appl. No.: 12/607,855

(22) Filed: Oct. 28, 2009

(51) Int. Cl.
*F23Q 3/00* (2006.01)

(52) U.S. Cl. ..... 361/253; 431/15; 431/287; 431/264; 431/183; 431/25

(58) Field of Classification Search ..... 431/264, 431/183, 25, 15, 253; 102/37.8; 361/235
See application file for complete search history.

(56) References Cited

U.S. PATENT DOCUMENTS

| | | | | |
|---|---|---|---|---|
| 4,120,638 | A * | 10/1978 | Straitz, III | 431/15 |
| 4,147,493 | A | 4/1979 | Straitz, III | |
| 4,192,641 | A | 3/1980 | Nakagawa et al. | |
| 4,450,499 | A | 5/1984 | Sorelle | |
| 4,711,629 | A * | 12/1987 | MacDonald | 431/264 |
| 4,871,307 | A * | 10/1989 | Harris et al. | 431/25 |
| 5,472,340 | A * | 12/1995 | Lynch | 431/183 |
| 6,530,795 | B2 * | 3/2003 | Maeda et al. | 439/287 |

* cited by examiner

*Primary Examiner* — Rexford Barnie
*Assistant Examiner* — Angela Brooks
(74) *Attorney, Agent, or Firm* — Buskop Law Group, PC; Wendy Buskop

(57) ABSTRACT

A flare ignition apparatus for igniting a flare having a power supply, a flare igniter, and a power-out cable for providing a spark. The flare igniter can be solar powered, and can have a water-tight enclosure, an actuating member, a coil, a condenser, and time-delay relays. The power-out cable can be disposed proximate a designated flare point on a flare stack.

19 Claims, 3 Drawing Sheets

FLARE IGNITION APPARATUS

FIELD

The present embodiments generally relate to a flare ignition apparatus for igniting a flare on a flare stack or tower, such as a flare stack used for controlling emissions.

BACKGROUND

A need exists for a flare ignition apparatus for controlling emissions that is environmentally friendly and does not need a pilot gas.

A need exists for a flare ignition apparatus that is portable and modular such that it can be used in various locations and is easily transported to those locations.

A need exists for a flare ignition apparatus that is contained within a water-tight enclosure such that the flare ignition apparatus will function under wet conditions.

A need exists for a flare ignition apparatus that is solar powered, thereby being better for the environment, reducing the need for the use of non-renewable fuels, and saving money.

The present embodiments meet these needs.

BRIEF DESCRIPTION OF THE DRAWINGS

The detailed description will be better understood in conjunction with the accompanying drawings as follows.

Figure 1:
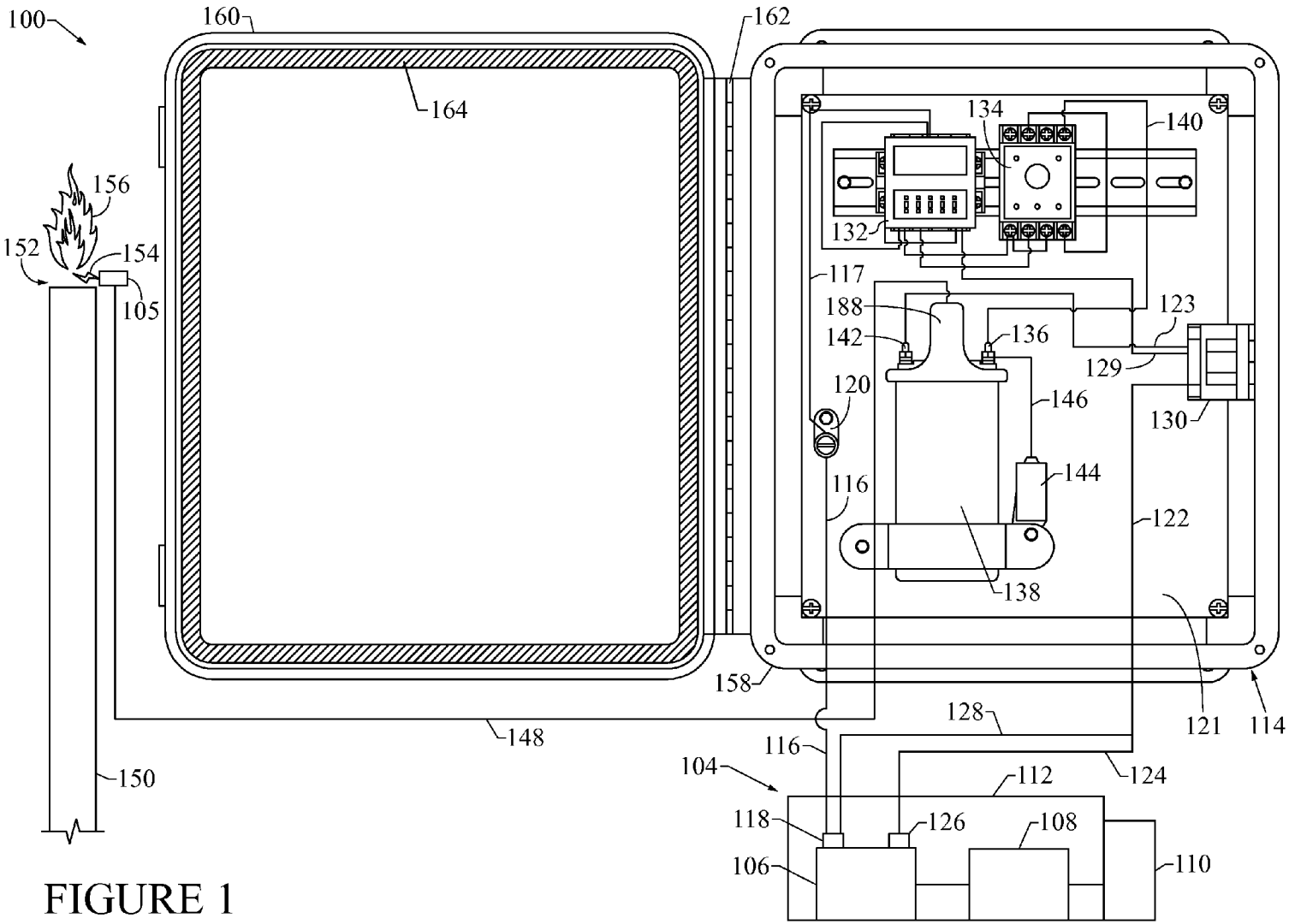
FIG. 1 shown an embodiment of the flare ignition apparatus.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a flare ignition apparatus having a flare igniter with a water-tight enclosure, a solar power supply, and a power-out cable for providing a spark. The flare ignition apparatus can be used for controlled ignition of gas, combustible gas, liquids, liquid fuels, and biofuels at designated flare points.

An example of a designated flare point in which embodiments of the apparatus can be used include a flare stack or tower. The flare stack can be located at an oil refinery, a natural gas power facility, a power plant, or some other chemical refinery and/or production facility. The flare ignition apparatus can be used to ignite natural gas flares or other types of combustible gasses. The flare ignition apparatus can spark as many times and as frequently as needed. The flare ignition apparatus can be used to control emissions from a flare stack.

The flare ignition apparatus can be solar powered. Being solar powered allows the flare ignition apparatus to be used in remote locations because the flare ignition apparatus can be recharged or powered anywhere that solar energy can be harnessed.

The flare ignition apparatus can produce a large spark from about ¼ inches to about 3 inches in length. The flare ignition apparatus can provide a spark even if the flare ignition apparatus gets wet, such as after the occurrence of a flare burp. The flare ignition apparatus does not require the use of a pilot gas, which can be extinguished by fluids such as rain water or petroleum fluids. Furthermore, eliminating the need for a pilot gas reduces consumption of non-renewable natural resources, saves money, and reduces the emissions caused by the burning of a pilot gas.

The flare ignition apparatus can be water-proof. Parts of the flare ignition apparatus can be disposed in a water-tight enclosure, preventing water from contacting those parts of the flare ignition apparatus. As used herein, water-proof at least in-part refers to the fact that water cannot pass into the water-tight enclosure. The flare ignition apparatus can thus produce a spark for igniting a flare, even if the flare ignition apparatus gets wet with water or another fluid.

Production of the present flare ignition apparatus can cost less than other flare igniters. Furthermore, use of the flare ignition apparatus can be more economical, as the flare ignition apparatus can utilize solar energy, thereby reducing the need to purchase other forms of energy.

The flare ignition apparatus can be automated, meaning that a user can install the flare ignition apparatus at a flare point and the user can then leave the flare ignition apparatus to operate. Once the flare ignition apparatus is installed no user is required to operate the flare ignition apparatus.

Embodiments of the flare ignition apparatus can be modular and can include a portable flare igniter, a portable power supply, and a portable power-out cable. Each of the parts of the flare ignition apparatus can be easily transported for use in various different and remote locations. The power supply can provide electrical energy to the portable flare igniter. The portable flare igniter can use the power provided by the power supply to produce an electrical signal and to send the electrical signal along the power-out cable, and the power-out cable can produce a spark with the electrical energy at an end of the power-out cable proximate a designated flare point.

The power supply can be disposed within a container such as a case or a box. A battery can be disposed within the power supply container. The power supply can further include a charging member for charging the battery. The charging member can be a battery charger in electrical communication with the battery. The power supply can also include a solar module such as a solar panel or cell. The power supply can be a 12 volt DC power supply.

In embodiments wherein the battery and the charger are disposed within a container, the solar module can be disposed on the outside of the container. The solar module can be electrically connected with the charging member for providing the charging member with electrical power. The charging member can in turn provide the electrical power to the battery for charging the battery.

The power supply can be electrically connected to the flare igniter. A power-in cable can connect the power supply to the flare igniter. The power-in cable can include a positive power-in cable connected to a positive terminal of the battery and a negative power-in cable connected to a negative terminal of the battery. The power-in cable can extend from the battery, into a water-tight enclosure of the flare igniter, and can connect to an actuating member within the water-tight enclosure.

The flare ignition apparatus can include a ground cable, for preventing any electrical shock to a user. One end of a ground cable can be connected to the negative terminal of the battery. The ground cable can extend from the negative terminal, into the water tight enclosure, and can connect with a grounding member disposed within the water-tight enclosure. The grounding member can be a back plate disposed within the water-tight enclosure. The ground cable can be connected to a grounding lug, which can be secured to the back plate for grounding the back plate.

The water-tight enclosure can keep all parts within the water-tight enclosure protected from getting wet from fluids, including water or petroleum fluids. The water-tight enclosure can be formed of any suitable material including: fiberglass, metal, plastic, polymeric materials, and any other material capable of providing a water-tight enclosure.

The water-tight enclosure can be formed generally as a box or a case for containing parts of the flare ignition apparatus. The water-tight enclosure can include a body, a door or lid connected to the body, and a seal disposed between the door and the body. The seal can be an elastomeric seal, a silicon seal, or any other type of seal capable of providing a water-tight seal when the door is closed onto the body. As used herein, a water-tight seal refers to a seal that keeps water or other fluids from passing through the seal.

At least one latch can be secured to the lid and/or the body to secure the lid to the body in a locking engagement. Other types of locking means can also be utilized to secure the door to the body in a locking engagement. The lid can be pivotably connected to the body. A hinge can be used to pivotably connect the lid and the body together.

The actuating member or on/off member can be disposed through the water-tight enclosure. The actuating member can be used for actuating the flare ignition apparatus, turning the flare ignition apparatus on and off. By disposing the actuating member through the water-tight enclosure, a user can initiate the flare igniter without opening the door of the water-tight enclosure, thereby eliminating the necessity to expose the contents of the water-tight enclosure to the surrounding environment.

A top end of the actuating member can extend outwards from the water-tight enclosure providing a user with access to the actuating member from outside of the water-tight enclosure. A user can turn the actuating member "on" or "off" with the top end of the actuating member. A bottom end of the actuating member can extend inwards into the water-tight enclosure for connecting to the power-in cable, to a coil, to a time-delay relay, or combinations thereof. The actuating member can be a switch, a knob, a dial, a lever, a button, or any other suitable means for allowing a user to switch between an on-state and an off-state of the flare igniter.

The coil can be disposed within the water-tight enclosure. A positive terminal of the coil can be connected to the actuating member with a positive electrical cable. A negative electrical cable can extend from the actuating member to a first time-delay relay. The first time-delay relay can be electrically connected to a second time-delay relay, such as with an electrical wire. The second time-delay relay can be electrically connected with a negative terminal of the coil, such as by an electrical cable, thereby completing an electrical circuit.

The coil can function to produce and send an electrical signal from the coil, along a power-out cable connected to a power-out terminal of the coil, and to an end of the power-out cable to produce a spark for igniting a flare.

The flare ignition apparatus can also include a condenser or capacitor which can be electrically connected in series to the coil, and can be disposed within the water-tight enclosure. The condenser can be connected to the negative terminal of the coil by an electrical wire. The condenser can function to prevent arcing between the positive and negative terminals of the coil.

The first time-delay relay can be disposed within the water-tight enclosure. The first time-delay relay can initiate the flare igniter using a set of intervals. The first time-delay relay can function to control how often the flare igniter produces a spark, and can function such that the flare igniter produces a spark at certain time intervals. The time intervals of the first time-delay relay can be preprogrammed into the first time-delay relay. For example, the first time-delay relay cause the flare ignition apparatus to produce a spark once every second, once every minute, once an hour, once a day, once a week, or another other time interval.

In embodiments, the first time-delay relay can be an 11 pin relay. The first time-delay relay can also be electrically connected to the grounding lug with a second ground wire.

The second time-delay relay can have a preprogrammed actuation duration time for controlling the duration of each actuation of the flare igniter. The second time-delay relay can be connected by wire, or otherwise be in electronic communication with the first time-delay relay. The second time-delay relay can be an 8 pin relay. For example, the second time-delay relay can function to cause the duration of each actuation of the flare igniter to last for two seconds, five seconds, ten seconds, or another period of time.

The back plate can be disposed within the water-tight enclosure. The condenser, the coil, and the first and second time-delay relays can be supported on the back plate. The back plate can be formed of aluminum, a metal, a plastic, a polymeric material, or any other suitable material.

A first time-delay relay base can be disposed within the water-tight enclosure for supporting the first time-delay relay. A second time-delay relay base can be disposed within the water-tight enclosure for supporting the second time-delay relay. Each of the relay bases can be formed of a non-conductive material, a metal, a plastic, a polymeric material, or any other suitable material. Each time-delay relay base can be secured to the back plate with a din rail bar, a strap, or some other suitable means of attachment. Each time-delay relay can connect to each relay base by pins on the time-delay relay.

The power-out cable can provide an electrical signal from the coil to an end of the power-out cable to provide a spark. The end of the power-out cable that provides the spark can be disposed anywhere that a spark is needed. The power-out cable can extend from the coil, out of the water-tight enclosure, and to a designated flare point of a flare stack, for providing a spark and for igniting a flare at the designated flare point.

A rod can be disposed at the end of the power-out cable. The rod can receive the electrical signal. The electrical signal can arc from the rod to a flare stack. The rod can be a stainless steel rod, or any other conducting material.

In embodiments, the flare igniter can be a low voltage direct current (DC) igniter. The voltage of the portable flare igniter can be a reduced voltage, such as 12 volts to 27 volts.

In embodiments, the flare stack can be a vertical flare stack, an inclined flare stack, an offshore flare stack, an onshore flare stack, or some other flare stack.

It can be contemplated that the power supply container can be a second water-tight enclosure formed substantially similar to the first water-tight enclosure for keeping the power supply protected from moisture.

In operation, the flare ignition apparatus can be easily transported to any work site for use, as it is modular and transportable. The flare igniter, the power supply, and the power-out cable can be connected together at the work site for use. A user can connect the power-in cable to the power supply and to the actuating member of the flare igniter. The user can further connect the power-out cable to the power-out terminal of the coil. The end of the power-out cable that provides the spark can be positioned proximate a designated flare point where a user desires to produce a flare.

The actuating member can be turned to an "on" position, thereby actuating the flare igniter. The actuating member can be used to selectively prevent or allow communication between the first time-delay relay and the power-in cable. The actuating member can actuate the flare igniter by completing a circuit between the negative power-in cable and the negative cable extending from actuating member to the first time-delay relay.

When the actuating member is turned "on" electricity can flow from the power supply to the first time-delay relay.

Electricity can then flow from the first time-delay relay to the second time-delay relay.

Electricity then flows from the second time-delay relay to the coil. The function of the coil is known by those in the art. The coil can have two constituent coils of wire contained within it. As electricity is flowing into the flare igniter and through the first constituent coil, a magnetic field is built up in the coil. When the flow of electricity through the first constituent coil ceases, the magnetic field collapses which induces a flow of electricity in the second constituent coil. The second constituent coil can be electrically connected to the power-out cable through a power-out terminal of the coil. The electricity in the second constituent coil can then flow from the coil, through the power-out cable, and to the sparking end of the power-out cable, for providing a spark. The spark then ignites any combustible materials, such as gasses, which are proximate the spark, thereby producing a flare.

Turning now to the Figures, FIG. 1 depicts an embodiment of the flare ignition apparatus 100. The flare ignition apparatus is shown having a flare igniter with a water-tight enclosure 114, a power supply 104, and a sparking end 105 of the power-out cable 148.

The power supply is depicted with a battery 106. The battery can be electrically connected to a charger 108. The charger is electrically connected to a solar module 110. The battery and charger are shown disposed within a power supply enclosure 112.

The water-tight enclosure 114 is shown opened so that the contents of the water-tight enclosure can be seen. However, the flare ignition apparatus can function with the water-tight enclosure closed.

The flare igniter is shown with a first ground cable 116 connected to a negative terminal 118 of the battery. The first ground cable extends from the negative terminal, into the water-tight enclosure, and connects with a grounding lug 120. The grounding lug is shown attached to a back plate 121.

A power-in cable 122 is shown extending from the battery. The power-in cable 122 has a positive power-in cable 124 connected to a positive terminal 126 of the battery. The power-in cable 122 also has a negative power-in cable 128 connected to the negative terminal of the battery. The power-in cable 122 extends from the battery, into the water-tight enclosure, and connects with an actuating member 130.

A negative cable 129 extends from the actuating member to the first time-delay relay 132. The first time-delay relay is shown electrically connected to a second time-delay relay 134.

The second time-delay relay 134 is shown connected to a negative terminal 136 of the coil 138 through a coil-in wire 140.

A positive cable 123 extends from the actuating member 130 to a positive terminal 142 of the coil 138.

A condenser or capacitor 144 is shown connected to the negative terminal 136 of the coil 138 with a condenser wire 146.

The power-out cable 148 is shown connected to a power-out terminal 188 of the coil 138. The power-out cable 148 extends from the coil 138 to the sparking end 105 of the power-out cable 148. The sparking end 105 of the power-out cable 148 is shown disposed on a flare stack 150 proximate a designated flare point 152, for generating a spark 154 to ignite a flare 156.

The water-tight enclosure is shown with a body 158, a door or lid 160, a hinge 162, and a seal 164 disposed around the edges of the lid.

A second ground cable 117 is depicted connected with the grounding lug 120 at one end, and the first time-delay relay 132 at the other end.

Figure 2:
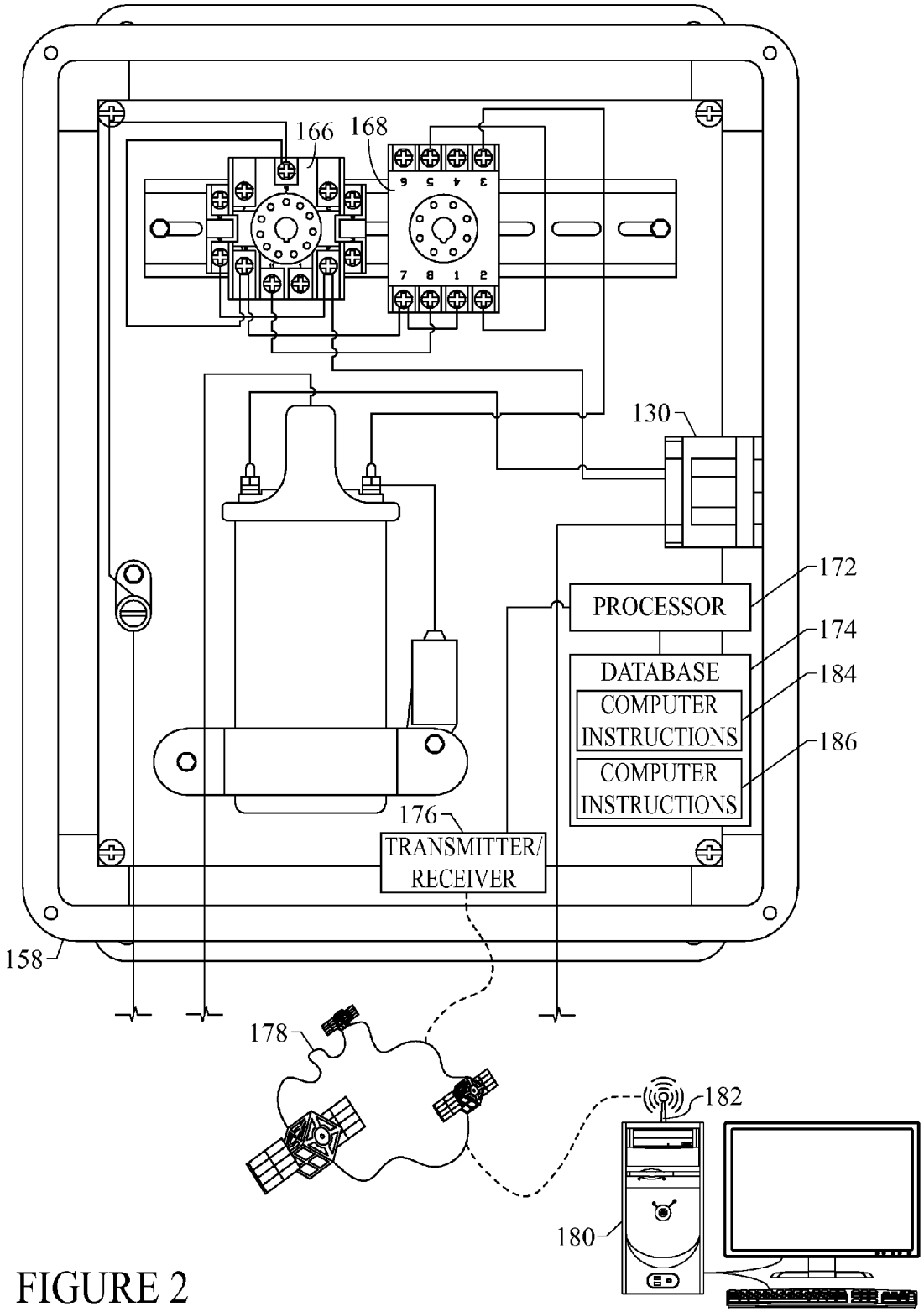
FIG. 2 shows an embodiment of the body of the flare ignition apparatus

FIG. 2 depicts the body 158 of the flare ignition apparatus and shows a first relay base 166 and a second relay base 168. Each relay can be attached to each relay base.

A processor 172 is shown in communication with a data storage 174. The processor is shown in communication with the actuating member 130. The processor can control the actuating member, turning the actuating member into an "on" or "off" position. A transmitter/receiver 176 is also shown in communication with the processor. The processor, the database, and the transmitter/receiver are all shown disposed within the water-tight enclosure.

The transmitter/receiver is shown in communication with a network 178, which is shown in communication with a client device 180. The network can be a satellite, a cellular network, or another type of wireless network. The client device can be a computer, a cellular phone, or any other communication device capable of directly or indirectly receiving signals from the network. The client device can have a transmitter/receiver 182 for sending commands to the processor and for receiving data from the processor through the transmitter/receiver 176.

The client device can be used to remotely control the flare ignition apparatus by sending a command to actuate the flare ignition apparatus. The client device can also be used to remotely turn off the flare ignition apparatus, such as in the case of an emergency situation wherein the flare ignition apparatus needs to be shut down.

The client device can also receive messages from the transmitter/receiver of the flare ignition apparatus which can include: whether or not the flare ignition apparatus is on or off; how many times the flare ignition apparatus has sparked; messages indicating a failure or an error of the flare igniter; whether or not the flare ignition apparatus successfully ignited a flare; whether or not gas is present at the flare point; and other information about the flare ignition apparatus.

The database 174 can have computer instructions for instructing the processor to send messages 184 to the client device and for instructing the processor to receive commands 186 from the client device. The flare ignition apparatus can be remotely controlled and monitored with the client device 180.

Figure 3:
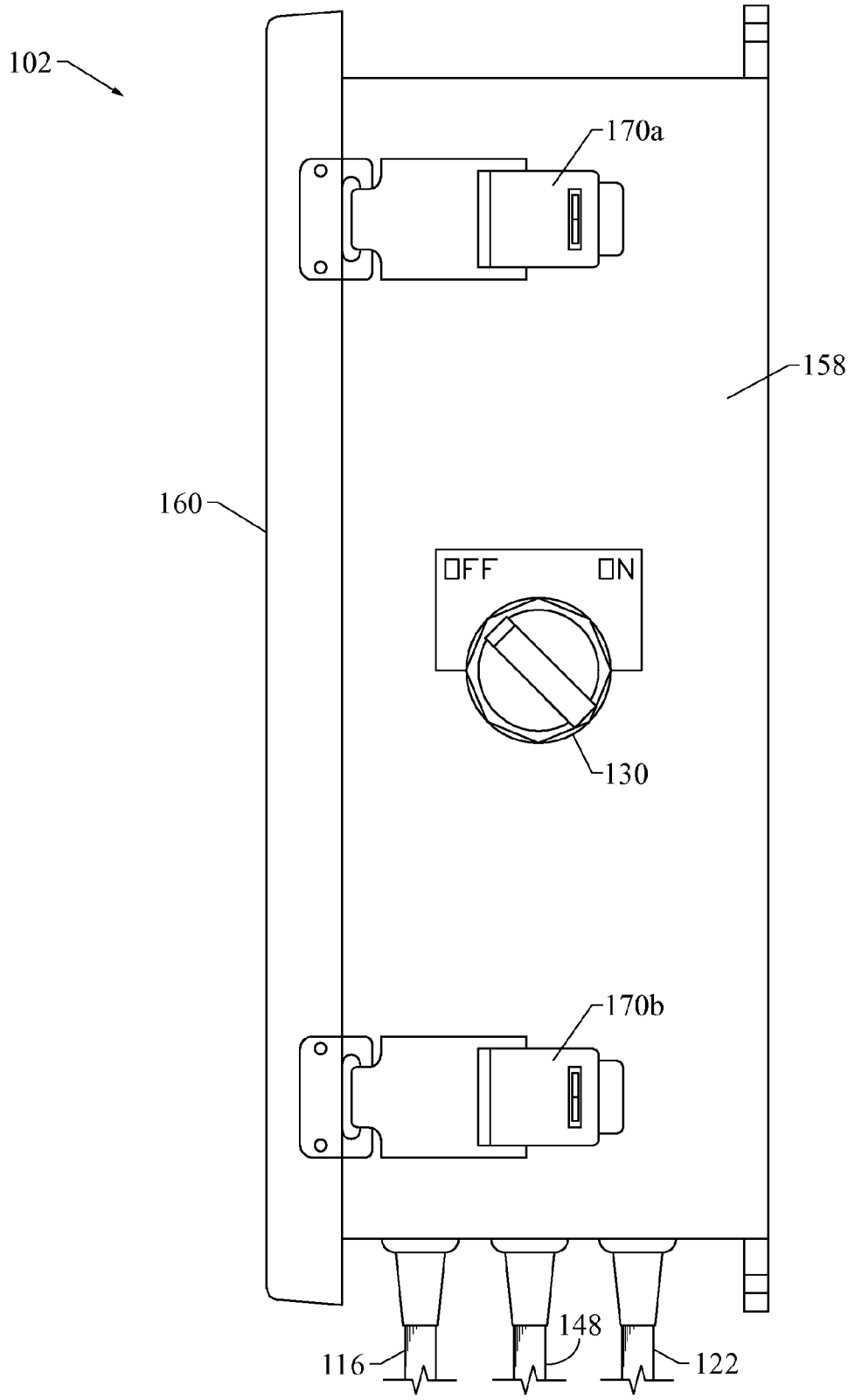
FIG. 3 shows a side view of an embodiment of the flare igniter.

FIG. 3 depicts a side view of an embodiment of the flare igniter 102 wherein the door or lid 160 is closed over the body 158. Two latches 170*a* and 170*b* are shown disposed on the top of the lid for providing a locking engagement of the lid over the body. Also, the top of the actuating member 130 can be seen. The first ground cable 116, the power-in cable 122, and the power-out cable 148 are show extending from the flare igniter.

While these embodiments have been described with emphasis on the embodiments, it should be understood that within the scope of the appended claims, the embodiments might be practiced other than as specifically described herein.

What is claimed is:

1. A flare ignition apparatus for igniting a flare, the apparatus comprising:

a. a power supply;

b. a flare igniter comprising:

(i) a power-in cable in communication with the power supply and with an actuating member;

(ii) a coil in communication with the actuating member, wherein the coil is disposed within a water-tight enclosure;

(iii) a first time-delay relay for initiating the flare igniter, wherein the first time-delay relay is disposed within the water-tight enclosure and is in communication with the actuating member, and wherein the actuating member selectively prevents or allows communication between the first time-delay relay and the power-in cable, wherein the first time-delay relay is an 11 pin relay;

(iv) a second time-delay relay for controlling a duration of each actuation of the flare igniter, wherein the second time-delay relay is disposed within the water-tight enclosure, and wherein the second time-delay relay is in communication with the first time-delay relay and with the coil, wherein the second time delay relay is an 8 pin relay; and (v) a power-out cable in communication with the coil, wherein an end of the power-out cable opposite the coil provides a spark.

2. The flare ignition apparatus of claim 1, wherein the actuating member is disposed through the water-tight enclosure.

3. The flare ignition apparatus of claim 1, further comprising a condenser or capacitor connected in series with the coil and disposed within the water-tight enclosure.

4. The flare ignition apparatus of claim 1, wherein the water-tight enclosure comprises:

a. a body;

b. a lid connected to the body;

c. a seal disposed between the body and the lid; and d. a locking means for providing a locking engagement between the lid and the body.

5. The flare ignition apparatus of claim 1, wherein an end of the power-out cable is disposed on a flare stack proximate a designated flare point, for igniting the flare.

6. The flare ignition apparatus of claim 1, further comprising:

a. a processor in communication with a database disposed within the water-tight enclosure, wherein the processor is in communication with the actuating member;

b. computer instructions within the database for instructing the processor to receive commands and to send messages through a transmitter/receiver; wherein the transmitter/receiver is in communication with the processor;

c. a network in communication with the transmitter/receiver; and d. a client device in communication with the network, for receiving messages from the processor and for sending commands to the processor, for remotely controlling the actuating member.

7. The flare ignition apparatus of claim 1, wherein the flare igniter is a low voltage direct current flare igniter.

8. The flare ignition apparatus of claim 7, wherein the low voltage is 12, 24 or 27 volts.

9. The flare ignition apparatus of claim 1, wherein the flare igniter further comprises a back plate disposed within the water-tight enclosure, wherein the back plate supports the coil, the first time-delay relay, and the second time-delay relay.

10. The flare ignition apparatus of claim 1, wherein the power supply comprises:

a. a solar module;

b. a charging device in communication with the solar module; and c. a battery in communication with the charging device, wherein the battery is in communication with the power-in cable.

11. The flare ignition apparatus of claim 10, wherein the battery and the charging device are disposed within a water-tight power supply enclosure.

12. The flare ignition apparatus of claim 10, wherein the battery comprises a positive terminal and a negative terminal, wherein the power-in cable comprises a positive power-in cable in communication with the positive terminal of the battery and a negative power-in cable in communication with the negative terminal of the battery, further wherein a first end of a ground cable is in communication with the negative terminal of battery and a second end of the ground cable is in communication with the back plate.

13. The flare ignition apparatus of claim 12, wherein a positive power-in cable connected to a positive terminal of the coil provides communication between the coil and the actuating member, wherein a negative cable provides communication between the first time-delay relay and the actuating member, and wherein the power-out cable connects to a power-out terminal of the coil, further wherein the negative cable is in communication with the negative power-in cable and the positive cable is in communication with the positive power-in cable through the actuating member.

14. The flare ignition apparatus of claim 12, wherein the second end of the ground cable is connected to a grounding lug secured to the back plate, further comprising a second ground cable connected at one end to the grounding lug and at the opposite end to the first time-delay relay.

15. A flare ignition apparatus comprising:

(i) a water-tight enclosure;

(ii) an actuating member disposed through the water-tight enclosure;

(iii) a power-in cable in communication with a solar power supply at one end and with the actuating member at the opposite end;

(iv) a coil in communication with the actuating member, for producing an electrical signal;

(v) at least one time-delay relay in communication with the coil and the actuating member; wherein the actuating member selectively prevents or allows communication between the at least one time-delay relay and the power-in cable, wherein the at least one time-delay relay is an 11 pin relay or an 8 pin relay; and (vi) a power-out cable in communication with the coil for receiving the electrical signal and for providing a spark.

16. The flare ignition apparatus of claim 15, wherein the water-tight enclosure comprises:

a. a body;

b. a lid;

c. a hinge connecting the lid to the body;

d. a water-tight seal disposed between the body and the lid; and e. a locking means for providing a locking engagement between the lid and the body.

17. The flare ignition apparatus of claim 15, wherein an end of the power-out cable is disposed on a flare stack for igniting a flare.

18. The flare ignition apparatus of claim 15, wherein the solar power supply comprises a solar panel and a battery in communication with the solar panel.

19. A flare ignition system for controlled ignition of combustible gasses or liquids at a designated flare point, comprising:

a. a power supply; and b. a portable flare igniter, wherein the portable flare igniter comprises:

(i) a water-tight enclosure;

(ii) an on-off switch disposed through the water-tight enclosure;

(iii) a coil connected in series with a condenser disposed within the water-tight enclosure; wherein the coil is further connected with the on-off switch;

(iv) a first time-delay relay disposed within the water-tight enclosure for initiating the portable flare igniter using a set of intervals; wherein the first time-delay relay is connected to the on-off switch, wherein the first time-delay relay is an 11 pin relay;

(v) a second time-delay relay disposed within the water-tight enclosure for controlling the duration of each actuation of the portable flare igniter; wherein the second time-delay relay is connected to the first time-delay relay, wherein the second time delay relay is an 8 pin relay;

(vi) a back plate disposed within the water-tight enclosure for supporting the condenser, the coil, and the first and second time-delay relays;

(vii) a power-in cable connected with the on/off switch, for receiving power from the power supply; wherein the actuating member selectively prevents or allows communication between the first time-delay relay and the power-in cable;

(viii) a power-out cable for providing a spark from the coil to a flare stack; and (ix) a ground cable connected with the power supply and with the back plate.

* * * * *